US009865938B2

(12) United States Patent
Meine et al.

(10) Patent No.: US 9,865,938 B2
(45) Date of Patent: Jan. 9, 2018

(54) APPARATUS FOR ELECTRICALLY BONDING A SOLAR ARRAY

(71) Applicant: Ironridge, Inc., Hayward, CA (US)

(72) Inventors: Shawn Meine, Phoenix, AZ (US); Jon Ash, Phoenix, AZ (US); Scott Ochenreider, Glendale, AZ (US)

(73) Assignee: Ironridge, Inc., Hayward, CA (US)

( * ) Notice: Subject to any disclaimer, the term of this patent is extended or adjusted under 35 U.S.C. 154(b) by 0 days.

(21) Appl. No.: 14/796,140

(22) Filed: Jul. 10, 2015

(65) Prior Publication Data

US 2016/0285177 A1 Sep. 29, 2016
US 2017/0264026 A9 Sep. 14, 2017

Related U.S. Application Data

(63) Continuation-in-part of application No. 13/542,570, filed on Jul. 5, 2012.

(60) Provisional application No. 62/137,948, filed on Mar. 25, 2015.

(51) Int. Cl.

| | |
|---|---|
| ***H01R 4/36*** | (2006.01) |
| ***H01R 4/38*** | (2006.01) |
| ***H01R 4/64*** | (2006.01) |
| ***H01R 4/34*** | (2006.01) |
| *H01R 4/24* | (2006.01) |
| *H01R 4/30* | (2006.01) |
| *H01R 25/14* | (2006.01) |

(52) U.S. Cl.

CPC ..... *H01R 4/34* (2013.01); *H01R 4/2408* (2013.01); *H01R 4/302* (2013.01); *H01R 4/36* (2013.01); *H01R 4/64* (2013.01); *H01R 25/142* (2013.01)

(58) Field of Classification Search

CPC ..... H01R 4/38; H01R 13/648; H01R 4/34; H01R 4/2408; H01R 4/302; H01R 4/36; H01R 4/64; H01R 25/142; F16B 35/007

USPC ... 439/100, 103, 108, 73, 435, 462, 54, 575, 439/782, 92, 94, 97, 444, 803, 927, 136; 411/84, 85, 106–109, 187, 188, 379

See application file for complete search history.

(56) References Cited

U.S. PATENT DOCUMENTS

| | | | | |
|---|---|---|---|---|
| 1,820,667 | A * | 8/1931 | Leyes | F16B 37/045 269/243 |
| 2,116,776 | A * | 5/1938 | Bondeson | H01R 4/38 439/804 |
| 3,761,867 | A * | 9/1973 | Churla | H01R 4/2479 411/160 |
| 4,806,108 | A | 2/1989 | Meinhardt | |
| 7,621,763 | B2 * | 11/2009 | Clark | H01R 4/36 439/100 |
| 7,987,641 | B2 * | 8/2011 | Cinnamon | F24J 2/5211 52/173.3 |

(Continued)

*Primary Examiner* — Amy Cohen Johnson
*Assistant Examiner* — Milagros Jeancharles
(74) *Attorney, Agent, or Firm* — Law Office of Lance C. Venable, PLLC

(57) ABSTRACT

In various representative aspects, an apparatus for securing solar panels to a rail support guide, while facilitating grounding by a common grounding wire. The apparatus is an electrically conductive lay-in-lug fastener, which facilitates multiple rows of solar panels to be electrically bonded to each other. The apparatus includes a lug member for securing the grounding wire. In doing so, the structure for securing the grounding wire is at an acute angle to the frame, enabling a wrench to be used even in space-challenged locations.

8 Claims, 4 Drawing Sheets

(56) References Cited

U.S. PATENT DOCUMENTS 8,025,508 B2 * 9/2011 Parker ..... H01R 4/36 439/92
8,070,404 B1 * 12/2011 Schluter ..... F16B 39/282 411/368
8,092,129 B2 * 1/2012 Wiley ..... F16B 7/187 411/160
8,152,575 B2 4/2012 Boling et al.
8,317,526 B2 * 11/2012 Gardner ..... H01R 4/36 24/489
8,360,811 B2 * 1/2013 Aoki ..... H01R 4/34 439/736
8,858,142 B2 * 10/2014 Suzuki ..... F16B 33/02 411/184
8,899,998 B2 * 12/2014 Pyron ..... H01R 4/30 439/100
9,038,329 B2 * 5/2015 Pelman ..... F24J 2/5233 136/244
9,074,616 B2 * 7/2015 Wiley ..... F16B 7/187
9,080,792 B2 * 7/2015 Patton ..... F24J 2/5245
9,106,067 B1 * 8/2015 Vernica ..... H01R 4/60
9,175,715 B2 * 11/2015 Babej ..... F16B 37/068
9,196,978 B2 * 11/2015 Magno ..... H01R 11/26
9,671,136 B2 * 6/2017 Ash ..... F24J 2/46
2006/0257229 A1 * 11/2006 Bucciferro ..... F16B 5/02 411/187
2008/0019800 A1 * 1/2008 Liu ..... F16B 39/282 411/531
2009/0064626 A1 * 3/2009 Sen ..... F16B 37/045 52/699
2009/0232616 A1 * 9/2009 Sekreta ..... F16B 35/06 411/107
2011/0214365 A1 * 9/2011 Aftanas ..... F24J 2/5258 52/173.3
2011/0299957 A1 * 12/2011 Young ..... F24J 2/5205 411/401
2014/0010616 A1 * 1/2014 Meine ..... F16B 7/187 411/190
2015/0311606 A1 * 10/2015 Meine ..... F16B 2/12 439/100
2017/0063300 A1 * 3/2017 Ash ..... H02S 20/23
2017/0085219 A1 * 3/2017 Ash ..... F16B 2/12

* cited by examiner

APPARATUS FOR ELECTRICALLY BONDING A SOLAR ARRAY

The application is a continuation-in-part of U.S. patent application Ser. No. 13/542,570, filed Jul. 5, 2012. The present invention relates generally to providing an apparatus used as a grounding mechanism to electrically bond a solar panel module array. More specifically, the invention relates to providing a lug to a mounting structure such as a rail that allows multiple rows of solar panels to be electrically bonded to each other.

BACKGROUND OF INVENTION

Field of the Invention

Existing solutions are either unsatisfying in providing sufficient electrical grounding capacity or too complicated to manufacture or install.

When installing a solar system into a location, it is sometimes effective to provide a common ground to link all of the solar arrays together. The structure for accomplishing this common link must accomplish two objectives. First, the structure must provide a secure electrical connection with the solar array. Second, the structure must facilitate a common grounding wire between the arrays.

As discussed relative to Applicant's earlier filed disclosures, specifically U.S. application Ser. Nos. 13/542,570 and 13/653,226, creating contact between rail of a solar array and the clamping device can be a challenge. The disclosure of these two US applications, are specifically incorporated into this application by reference. The teaching found in these disclosures is applied to the structure disclosed in the present invention and will be more fully appreciated as described in detail below.

Conventional fasteners typically do not pierce the surfaces layers of rail support guides. As will be appreciated, these fasteners do not provide the proper electrical contact and therefore can result in insufficient operation of the solar array.

In typical present structure, one end of the fastener is attached to the rail support guide of the solar array. As previously stated, prior methods and structures have been found lacking. Electrical contact is typically incapable of occurring, even immediately after installation. Quite clearly this is an unacceptable condition.

In a typical existing structure, another portion of the fastener is used to provide a support for connecting the common grounding wire to the fastener. The support defines what is known as a lay-in lug. Once placed on the lay-in lug, a screw is threaded through an opening in the fastener and tightened so that the common grounding wire is held there securely. Typically, a wrench is applied to the opposed end of the screw and tightened to secure the common grounding wire.

Also, typical of these structures, the opening is generally upright and perpendicular to the point of contact within the fastener. In places where space is an issue, it is often not possible to utilize a wrench to tighten the screw against the grounding wire to provide a secure electrical connection. Thus, very often it has been found that, solid electrical contact is not achievable in these installations. What is needed is a fastener that is both easy to install and provides solid electrical contact.

SUMMARY OF THE INVENTION

This disclosure is summarized below only for purposes of introducing embodiments of the invention. The ultimate scope of the disclosure is to be limited only to the claims that follow the specification.

This disclosure provides an apparatus for grounding a solar panel array to a common grounding wire. The apparatus is a lug fastener, which facilitates multiple rows of solar panels to be electrically bonded to each other. The lug fastener defines a frame that has proximal and distal ends. A clamp assembly is located at the distal end and includes a first member having an enlarged end. The enlarged end defines a T-bolt member and includes at least one raised portion. The raised portion is designed to penetrate any surface treatment layers present on the rail support guide. This creates solid electrical contact and provides a grounding path for the solar panel array.

The clamp assembly includes a shank extending from the enlarged end and a nut end on the opposite end of the shank for securing the fastener to the rail support guide. The frame has an opening at the distal end for allowing passage of the shank. At the proximal end, the frame includes a lug member for securing the grounding wire. In doing so, the structure for securing the grounding wire is at an acute angle with respect to the top of the rail support guide, enabling a tool such as a socket wrench to be used even in space challenged locations.

In an exemplary embodiment, each of the above described elements is electrically conductive. Thus, when the raised portions penetrate any surface treatment layer of the rail support guide and the lug member makes solid electrical contact to the common grounding wire, the basic electrical circuit is established. The process is repeated for each lug member so that the common grounding wire connects each of the arrays.

In an exemplary embodiment, the proximal end of the frame includes the lug member. In this embodiment, an opening is cut through the lug member at an acute angle. The securing member of the lug member defines a threaded screw having a nut end adapted to be rotated by a tool such as a socket wrench and an elongated threaded member defining a shank. The opening is sized and shaped to have internal screw threads compatible with the shank. The lug member includes a lay portion for accommodating the common grounding wire. Once the common grounding wire is placed in the lay portion, the screw is rotated by turning the nut end with the tool.

A person with ordinary skill in the relevant art would know that any shape or size of the fastener may be adopted as long as the assembly can be used in a manner consistent with the above function. Also, any materials suitable to achieve the object of the current invention may be chosen, such as stainless steel or metallic materials.

BRIEF DESCRIPTION OF THE DRAWINGS

A more complete understanding of the present invention may be derived by referring to the detailed description and claims when considered in connection with the following illustrative figures. In the following figures, like reference numbers refer to similar elements and steps throughout the figures.

DETAILED DESCRIPTION OF THE EXEMPLARY EMBODIMENTS

In the following description, and for the purposes of explanation, numerous specific details are provided to thoroughly understand the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed embodiments may be applied. The full scope of the inventions is not limited to the examples that are described below.

Figure 1:
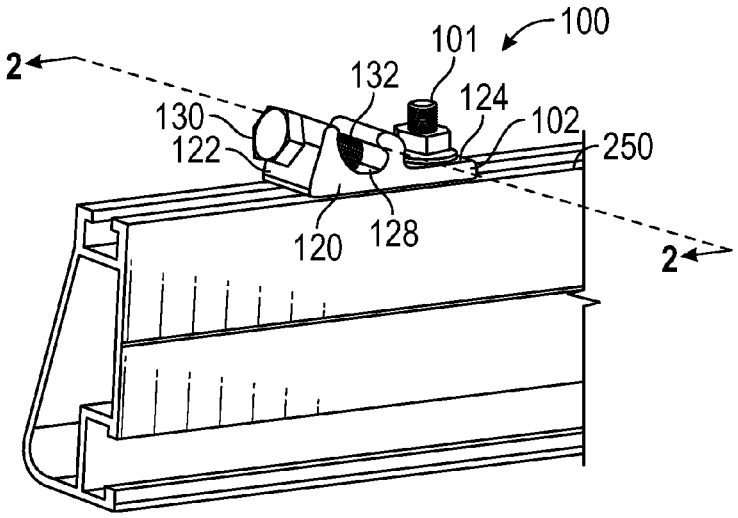
FIG. 1 illustrates a perspective view of an exemplary embodiment of the apparatus in accordance with the disclosure.
Figure 2:
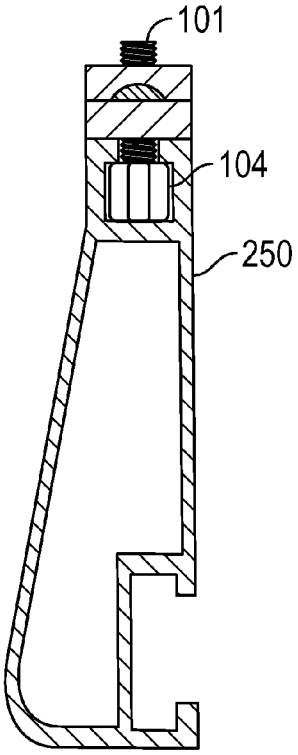
FIG. 2 is a cross-sectional view of the exemplary embodiment of the apparatus of FIG. 1, taken along line 2-2 looking in the direction of the arrows.

FIGS. 1 and 2 illustrate an exemplary embodiment of an apparatus for grounding a solar panel array to a common grounding wire. As illustrated, the apparatus includes a lug fastener shown generally by the numeral 100. The fastener 100 sits in a rail support guide 250 and slides into the desired position as will be more fully appreciated with reference to the description below. A rail support guide can also be present on the frame of a solar panel module in certain designs of solar panel arrays.

Figure 3:
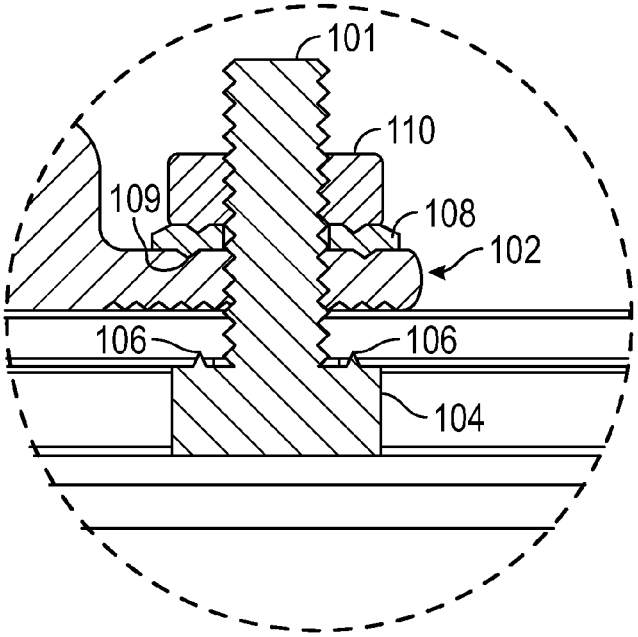
FIG. 3 illustrates a cross-sectional close-up view of the T-bolt end having a raised portion piercing the rail.

The fastener 100 defines a lug-type fastener. The fastener 100 includes a frame 120 having a proximal end 122 and a distal end 124. The distal end 124 of the fastener 100 defines a clamp assembly 102. The assembly 102 includes a threaded shank 101 and an enlarged end defining a T-bolt end 104. As illustrated in FIG. 3, the T-bolt end 104 has at least one raised portion 106. The raised portions 106 are typically sharp ridges designed to pierce a surface treatment layer, which may include oxidation or anodization layers on the outer portion of the exposed rail guide 250 in order to create a solid electrical contact between the apparatus 100 and the electrically conductive portion of the rail support guide 250 beneath the surface treatment layer.

It will be appreciated that various other raised portion structures are within the spirit and scope of this disclosure. In fact, Applicant's previously filed applications disclose similar structures. Those disclosures include the raised portion defining at least one penetrating elements circling the shank 101 or are present on the enlarged end 104 in different exemplary embodiments. Those disclosures are set forth in application Ser. Nos. 13/542,570 and 13/653,226 are specifically incorporated herein by reference.

As in the earlier disclosures, now specifically incorporated by reference into this disclosure, the assembly 102 includes a washer 108 and a nut 110. It is understood by those skilled in the art that the washer 108 and nut 110 may be separate components or integrated into a single unit. The washer 108 also includes at least one raised portion 109. In order to secure the fastener 100 to the rail support guide 250, the T-bolt 104 is first perpendicularly inserted along the rail support guide where the fastener 100 is to be secured. As the nut 110 is tightened, the raised portions 106 of the T-bolt 104 pierce the surface treatment layer of the rail support guide 250 so that it stabilizes the T-bolt 104, while at the same time and the raised portions 109 of the washer 108 penetrate and make electrical contact with the assembly 102. As the nut 110 is further tightened the raised portion 106 makes electrical contact with the rail support guide as shown in FIG. 3. By assembling the parts as described above, an electrical bonding path is created from the rail support guide 250, to the T-bolt 104 through the nut 110, the washer 108, the assembly 102, and the grounding wire 200 (as referenced below).

Adjacent the distal end 124 of the frame 120, the frame 120 has an opening, sized and shaped to allow the passage of threaded shank 101. The nut 110 is applied to the threaded shank 101 after the shank 101 is passed through the opening.

Figure 5:
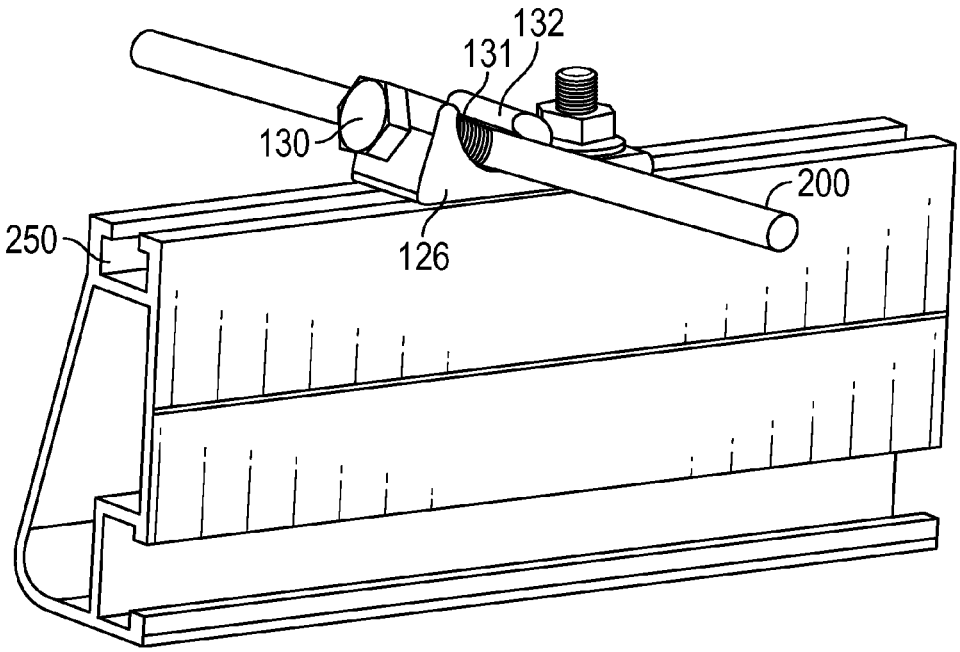
FIG. 5 illustrates a grounding wire being connected to the apparatus of FIG. 1.

The proximal end 122 of the frame 120 includes a lug portion 126. The lug portion 126 has a lay portion 128. As shown most clearly in FIGS. 5 & 7, a grounding wire 200 lies in the lay portion 128. The frame 120 includes a securing member 131 defining a threaded screw, having a nut end 130 and a threaded shank 132. The lug portion 126 includes an opening for receiving the threaded shank 132 and is sized and shaped to allow the threaded shank 132 to pass through the opening.

Figure 6:
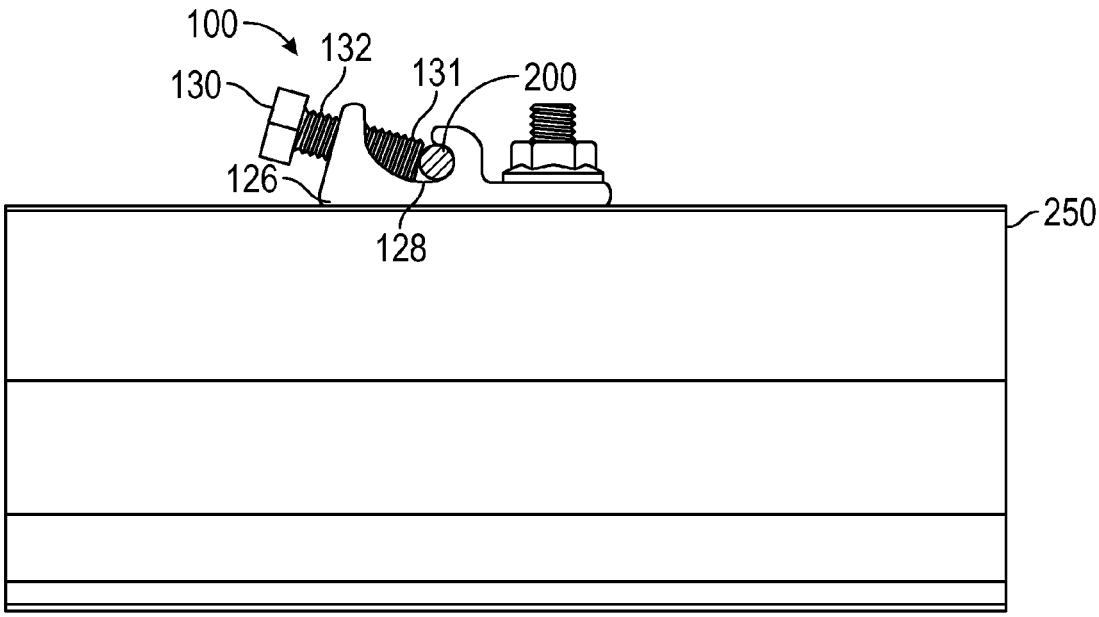
FIG. 6 illustrates a front view of the grounding wire connected to the apparatus in accordance with this disclosure.

As best shown in FIG. 6, the opening is cut through the lug portion 126 at an acute angle. By cutting the opening through the lug portion 126 of the frame 120, a tool such as a socket wrench as shown in FIG. 4 can be easily applied to the nut end 130 to facilitate the installation of the grounding wire 200.

Figure 4:
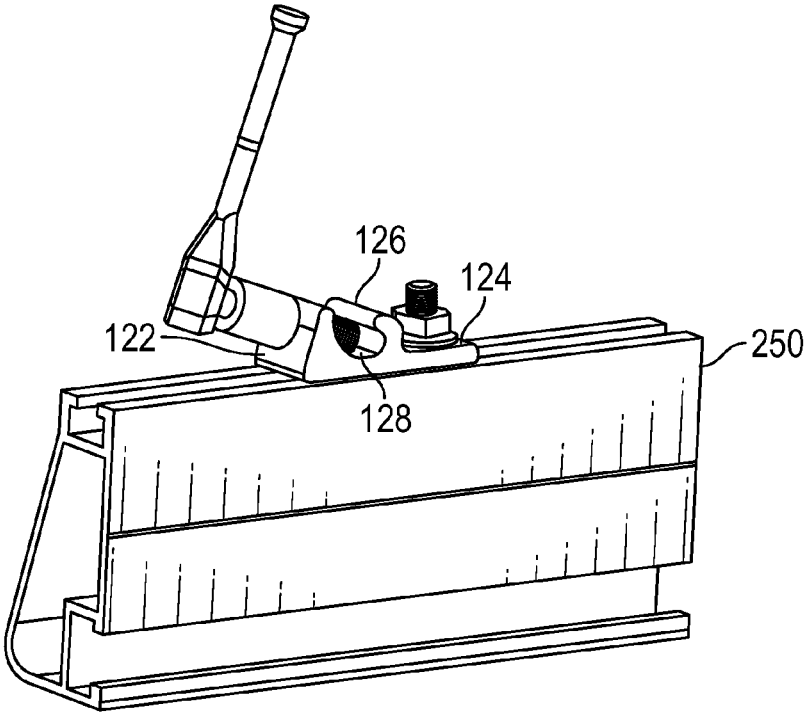
FIG. 4 illustrates a wrenching tool attached to the apparatus.

As illustrated in FIG. 4, the wrench is connected to the nut end 130 at an acute angle. After the apparatus 100 is fixed in position as described above, the grounding wire 200, as shown in FIGS. 5 & 7, is placed in the lay portion 128. Upon achieving the desired placement and positioning, the wrench of FIG. 4 is used to firmly attach the grounding wire 200 to the apparatus 100. It will be appreciated by those skilled in the art that the acute angle of opening allows application of the wrench to the nut end 130 making the installation of the equipment far easier than the current methodology by allowing a tool such as a socket wrench to more easily tighten the nut end 130 to the grounding wire 200 and thereby ground the lug 120 to the rail support guide 250.

As shown in FIG. 6, the apparatus 100 is firmly connected to the fastener 100. Further tightening of the nut end 130 will cause deformation of the grounding wire 200. In some exemplary methods of applying the apparatus of the disclosure to use, the deformation is desired. The primary objective is, however, the same, which is to make solid electrical contact between the apparatus and the grounding wire, regardless of which method is employed.

To facilitate solid electrical contact, in an exemplary embodiment of the apparatus, each element is made from electrically conductive material. Thus, all of the above described elements of the apparatus 100 are electrically conductive in the exemplary embodiments above. It will be appreciated by those skilled in the art, that portions or the entire element may be non-conductive in exemplary embodiments within the spirit and scope of the disclosure.

Figure 7:
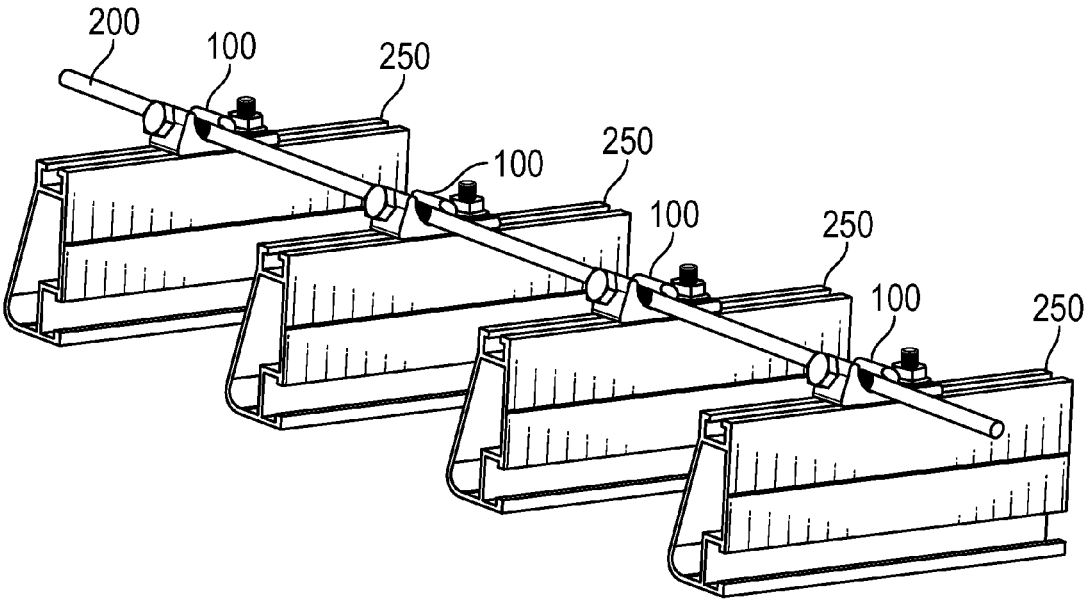
FIG. 7 illustrates a series of rail support guides connected together and employing a single grounding wire.

With particular reference to FIG. 7, there is shown a plurality of rail guides 250 having a common grounding wire 200. Each rail guide 250 includes a fastener 100 affixed as described above. In this manner, all of the rails can be effectively and efficiently grounded without a minimum of installation and cost of materials.

In an exemplary embodiment, the common ground wire 200 is a copper wire. It will, of course, be appreciated that a wide variety of materials may be used within the spirit and scope of the invention. As long as the wire functions as a grounding wire, it is to be considered within the scope of the disclosure and invention herein.

Figure 8:
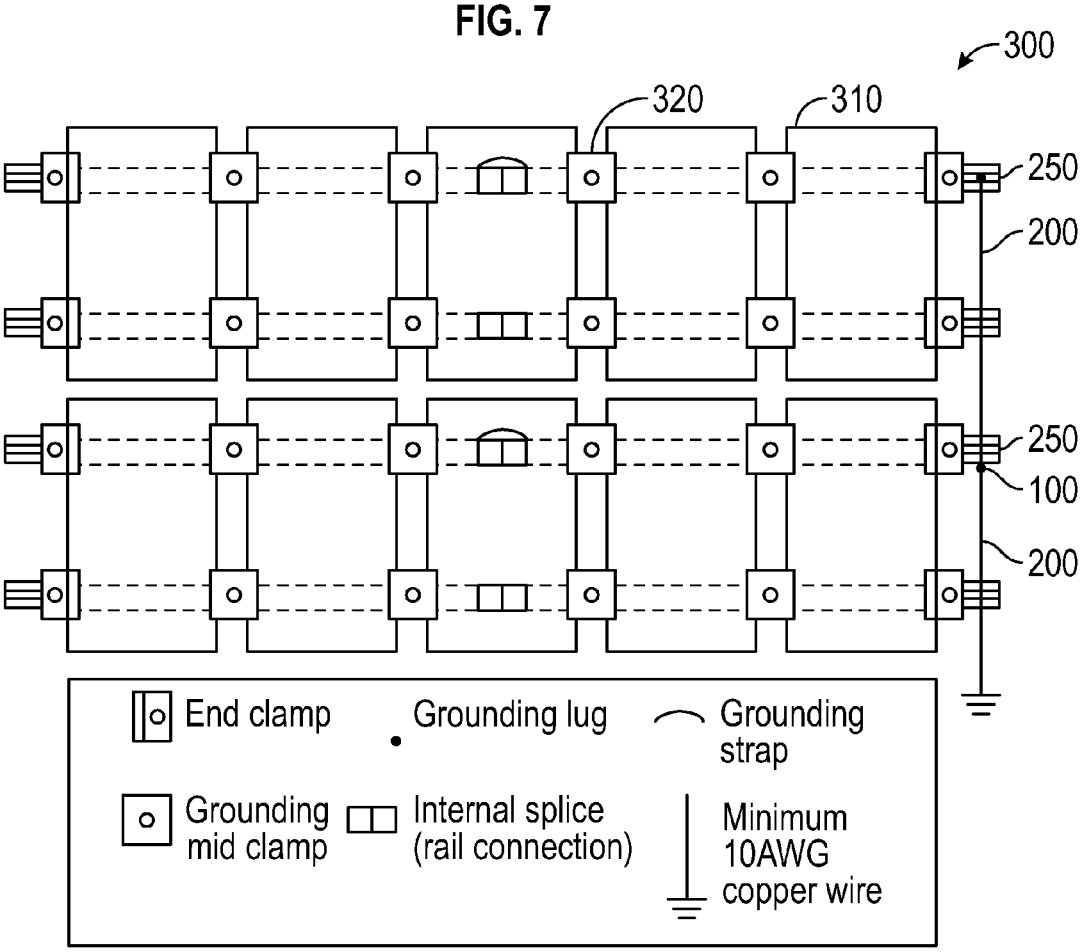
FIG. 8 illustrates, in schematic, a wiring diagram for the apparatus disclosed herein.

With reference to FIG. 8, there is illustrated, in schematic format, the wiring diagram of an exemplary embodiment of a solar panel array 300. As will be appreciated by those skilled in the art, the solar panel array 300 includes a plurality of solar panels 310 arranged in a manner that allows the common ground wire 200 to provide an electrical connection between each of the rail guides 250, which in turn provides an electrical connection between the respective solar panels 310 in the array 300. As described in the other disclosures incorporated by reference to this application, the solar panels are electrically connected to each other by way of mid clamps 320. The apparatus 100 that utilizes an angled lug 126, allows an installer to more easily and efficiently install the solar panel array with an electrical connection between the respective solar panels 310 that would not otherwise be available in the current state of the art.

While the foregoing detailed description has described several embodiments of the clamping assembly with grounding circuit in accordance with this disclosure, it is to be understood that the above description is illustrative only and not limiting of the disclosed invention. Particularly, the type of teeth used and various levels of hardness for the material piercing the surface layers may vary depending upon the situation. Additional, other variations are noted above and will be readily understood by those skilled in the art of fastening and more particularly mounting solar panels. It will be appreciated that the embodiments discussed above and the virtually infinite embodiments that could have easily been mentioned are all within the scope and spirit of this disclosure. Thus, the invention is to be limited only by the claims as set forth below.

What is claimed is:

1. An apparatus for facilitating the completion of an electrical circuit in a solar panel array having an electrically conductive rail support guide and using a common grounding wire, the apparatus comprising:

a fastener having a frame, the frame having a proximal end and a distal end;

a clamp assembly located at the distal end, the clamp assembly further comprising:

a first member having an enlarged end, the enlarged end comprising at least one raise portion configured to penetrate a surface treatment layer of the rail support guide to contact the electrically conductive portion of the rail support guide for creating a grounding path for the solar panel array, wherein the enlarged end is insertable in a first orientation along a length of the rail support guide and rotatable to a second orientation when the enlarged end engages the rail support guide;

a shank extending from the enlarged end, the shank further comprising a nut end on the opposite end of the enlarged end for securing the fastener to the rail support guide; and the frame further comprising an opening at the distal end for allowing passage of the shank; and the frame further comprising a lug member on the proximal end for securing the common grounding wire.

2. The assembly of claim 1, wherein the lug member further comprises an opening that is at an acute angle with respect to the rail support guide wherein the lug member further comprises a securing member for passing through the opening for contacting the grounding wire and securing it to the assembly.

3. The assembly of claim 2, wherein the securing member has a nut end and a shank, the acute angled opening allows the shank to pass through.

4. The assembly of claim 3, wherein the shank and the opening are compatibly threaded and wherein the nut end can be rotated to connect the grounding wire to the frame.

5. The assembly of claim 4, wherein the clamp assembly includes a washer between the nut end and the enlarged end.

6. The assembly of claim 5, wherein the fastener and each of its elements are electrically conductive.

7. The assembly of claim 6 wherein the washer further comprises at least one raised portion for penetrating the assembly.

8. The assembly of claim 7, wherein the common grounding wire is secured to a plurality of lug members that are secured to a corresponding rail support guide that provides an electrical conducting path between the rail support guides.

* * * * *